US006990921B2

(12) United States Patent
Milner et al.

(10) Patent No.: US 6,990,921 B2
(45) Date of Patent: Jan. 31, 2006

(54) SELF-WAVING FLAG

(76) Inventors: Ronald E. Milner, 13339 Fawn Hill Dr., Grass Valley, CA (US) 95945; Richard C. Levy, P.O. Box 34828, Bethesda, MD (US) 20827

( * ) Notice: Subject to any disclaimer, the term of this patent is extended or adjusted under 35 U.S.C. 154(b) by 0 days.

(21) Appl. No.: 10/862,442

(22) Filed: Jun. 8, 2004

(65) Prior Publication Data

US 2005/0178312 A1 Aug. 18, 2005

Related U.S. Application Data

(60) Provisional application No. 60/544,927, filed on Feb. 17, 2004.

(51) Int. Cl.
*G09F 17/00* (2006.01)

(52) U.S. Cl. ..... 116/173; 40/218

(58) Field of Classification Search ..... 116/173, 116/174; 40/218, 411, 414, 421, 423
See application file for complete search history.

(56) References Cited

U.S. PATENT DOCUMENTS

| | | | | |
|---|---|---|---|---|
| 1,256,232 A * | 2/1918 | Howard | 116/173 |
| 1,294,032 A | 2/1919 | Bixby | 116/173 |
| 1,453,772 A | 5/1923 | Trachtenberg | 40/218 |
| 2,035,308 A | 3/1936 | Ferber | 446/158 |
| 2,194,537 A | 3/1940 | Adams | 446/353 |
| 2,302,524 A * | 11/1942 | Borregard | 40/218 |
| 4,775,351 A | 10/1988 | Provenzano | 446/175 |
| 4,903,424 A | 2/1990 | Satoh et al. | 40/414 |
| 5,056,249 A | 10/1991 | Sakurai | 40/414 |
| 5,090,936 A | 2/1992 | Satoh et al. | 446/175 |
| 5,373,287 A * | 12/1994 | Doublet | 340/825.69 |
| 5,628,667 A | 5/1997 | Levi | 446/278 |
| 5,692,328 A * | 12/1997 | Pettit | 40/218 |
| 6,455,767 B1 * | 9/2002 | Muller | 136/245 |
| 6,634,123 B1 | 10/2003 | Bradley et al. | 40/214 |

FOREIGN PATENT DOCUMENTS

FR 2826993 A1 * 1/2003

* cited by examiner

*Primary Examiner*—R. Alexander Smith
(74) *Attorney, Agent, or Firm*—Nixon & Vanderhye, P.C.

(57) ABSTRACT

A flexible flag has a plurality of spiral shaped wire elements carried by the flexible flag body. The wire elements are mounted for rotation about generally parallel axes along a vertical support. Gearing between a motor and the elements rotates the elements. The elements have portions spaced from their end portions offset from the axes of rotation. Those elements are in phase or out of phase relative to one another. Rotation of the elements causes a rippling or waving effect in the flag simulative of a flag waving in the breeze.

22 Claims, 3 Drawing Sheets

SELF-WAVING FLAG

CROSS-REFERENCE TO RELATED APPLICATIONS

This application is a continuation of provisional application Ser. No. 60/544,927 filed Feb. 17, 2004, titled "SELF-WAVING FLAG."

FIELD OF THE INVENTION

The present invention relates to flags, and particularly relates to apparatus for mechanically causing the flag to wave simulating the motion of a flag in the wind.

BACKGROUND OF THE INVENTION

Flags displayed outdoors are typically seen as rippling in the wind. A similar rippling effect is achieved by waving the flag by hand. The manual movement of the flag pole causes the flag to ripple in the wind. There are, however, indoor displays of flags which are commonly not waved. These flags are typically constrained to hang limply from their support, e.g., a flag pole, or the flags may be held out in a display condition without any waving or rippling effects, i.e., they are held rigidly.

Various mechanical apparatus have been proposed to wave a flag, e.g., indoors. For example, U.S. Pat. No. 1,453,772 discloses an extensive mechanical linkage which folds and unfolds a flag in a fan-fold pattern and is driven by a motor in the base of the flag pole which according to the patent simulates the appearance of a waving flag. U.S. Pat. No. 6,634,123 discloses a flag mounted on a pole pivotally mounted at its base. An electric motor oscillates the pole to wave the flag. Accordingly, there is a need for a more realistic simulation of the waving or rippling effect of a flag. I would still like to disclose the other patents we found.

In accordance with a preferred aspect of the present invention, there is provided a flag, which includes an elongated support such as a flagpole for carrying the flag. A plurality of elongated elements carried by the elongated support, e.g., wires or thin flexible plastic wires, carry the flag body at spaced locations from one another and have end portions. The end portions are rotated, e.g., by gearing within the support to rotate the elements about generally parallel spaced axes. Portions of the elements spaced from the end portions are offset from the axes of rotation, e.g. the elements may have spiral or sinuous configurations. Consequently, by rotating the elements, the flag body follows the motion of the offset portions of the elements causing a rippling or waving effect along the flexible flag body.

More particularly, there is provided apparatus for waving a flag having a flexible flag body, an elongated support and a plurality of elongated elements carried by the support and spaced from one another, the elements extending generally along the flag body and projecting the flag body generally laterally of the support. The elements also have end portions carried by the support for rotation about generally parallel axes, the end portions being spaced from one another along the support. Portions along the elements extending generally laterally from the end portions lie offset from the axes of rotation. For example, the elements may have a generally spiral configuration with increasing diameter from the end portions of the elements connecting the elements to the support. Means are also provided for rotating the elements about the axes of rotation enabling the flag body to follow the motion of the offset portions thereby causing a rippling effect along the flexible flag body.

In a preferred embodiment of the invention, there is provided an apparatus for waving a flag comprising: a flexible flag body; an elongated support; and a plurality of elongated elements carried by said support and spaced from one another along said flag body; said elements having movable non-linear portions spaced from one another and engageable with said flag body enabling the flag body to follow the movement of the non-linear portions thereby causing a rippling effect along the flexible flag body.

In a further preferred embodiment of the invention, there is provided an apparatus for waving a flag comprising a flexible flag body; an elongated support; and a plurality of elongated elements carried by the support and spaced from one another, the elements extending generally along the flag body projecting the flag body generally laterally of the support and having end portions carried by the support for rotation about generally parallel axes, the end portions being spaced from one another along the support; portions along said elements spaced generally laterally from the end portions lying offset from the axes of rotation; and means for rotating the elements about the axes of rotation enabling the flag body to follow the motion of the offset portions thereby causing a rippling effect along the flexible flag body.

DETAILED DESCRIPTION OF THE INVENTION

Figure 1:
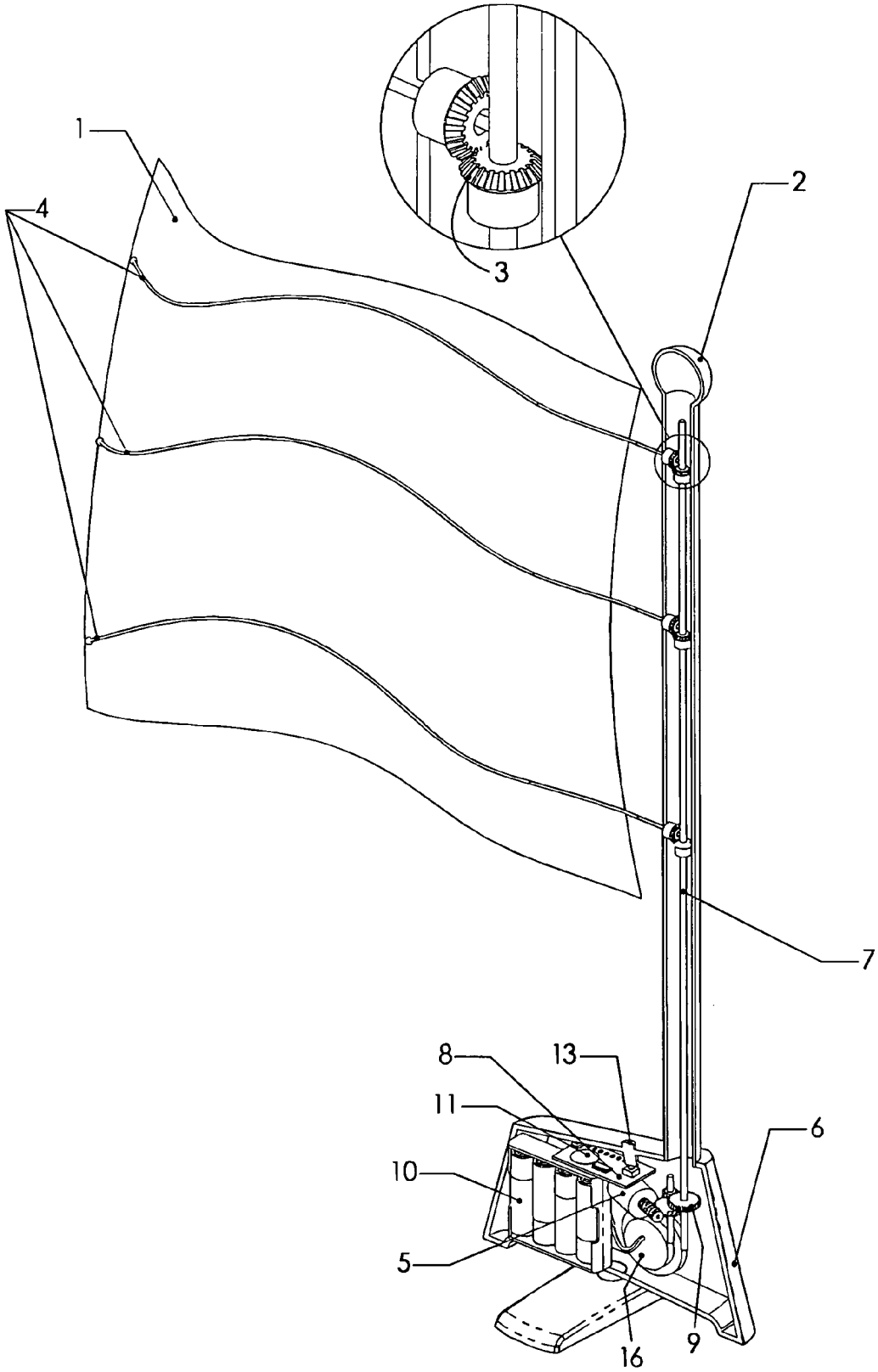
FIG. 1 is a perspective view of an apparatus for waving a flag in accordance with a preferred embodiment of the present invention with portions thereof broken out for clarity.

Referring to FIG. 1 a flag 1 is mounted on an elongated support 2, e.g., a flag pole. By the term flag is meant any one of a banner, ensign, standard, colors, jack, pennant, pendant, pennon and a streamer. A plurality of elements e.g., flexible wires 4, which may be formed of metal or plastic, but which also have some rigidity, are preferably sewn into sleeves or pockets in the flag (FIG. 4) or may be held to the flag body by rings or loops. The elements 4 are preferably formed in the shape of an elongated spiral, e.g., a sinuous configuration. It will be appreciated however, that other shapes may be provided which produce similar effects.

A motor 5 is powered by batteries 10 in a base 6 to which the support, e.g., flag pole 2 is secured. Within the support 2, there is a shaft 7 which is geared by gears 9 to the motor 10 such that, upon operation of the motor, the shaft 7 rotates within support 2. Shaft 7 carries bevel gears 3 at spaced vertical locations therealong which mesh with bevel gears secured to end portions of the elements 4 which project through bushings in the support 2.

Figure 3:
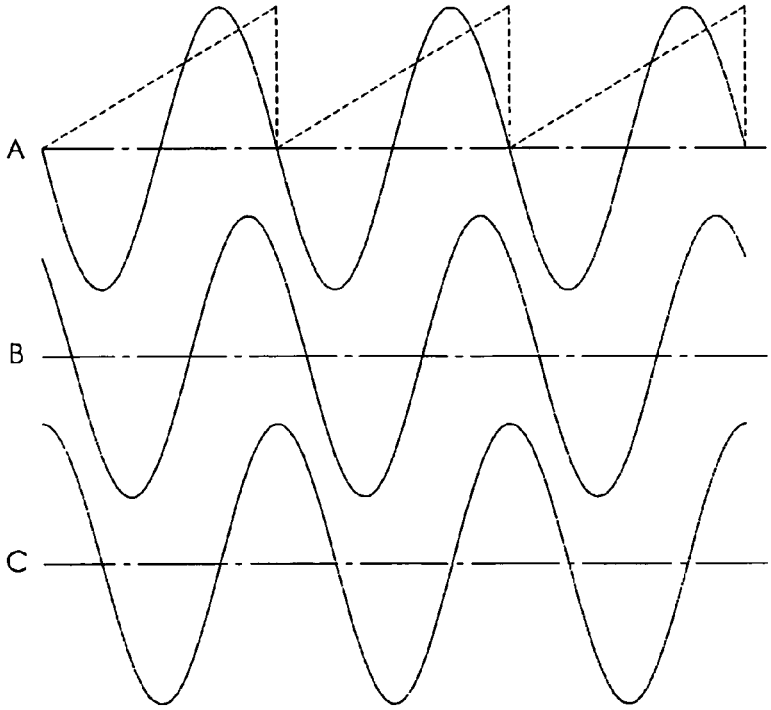
FIG. 3 is a diagrammatic illustration of an out-of-phase relationship of the elements when rotated to wave the flag.
Figure 4:
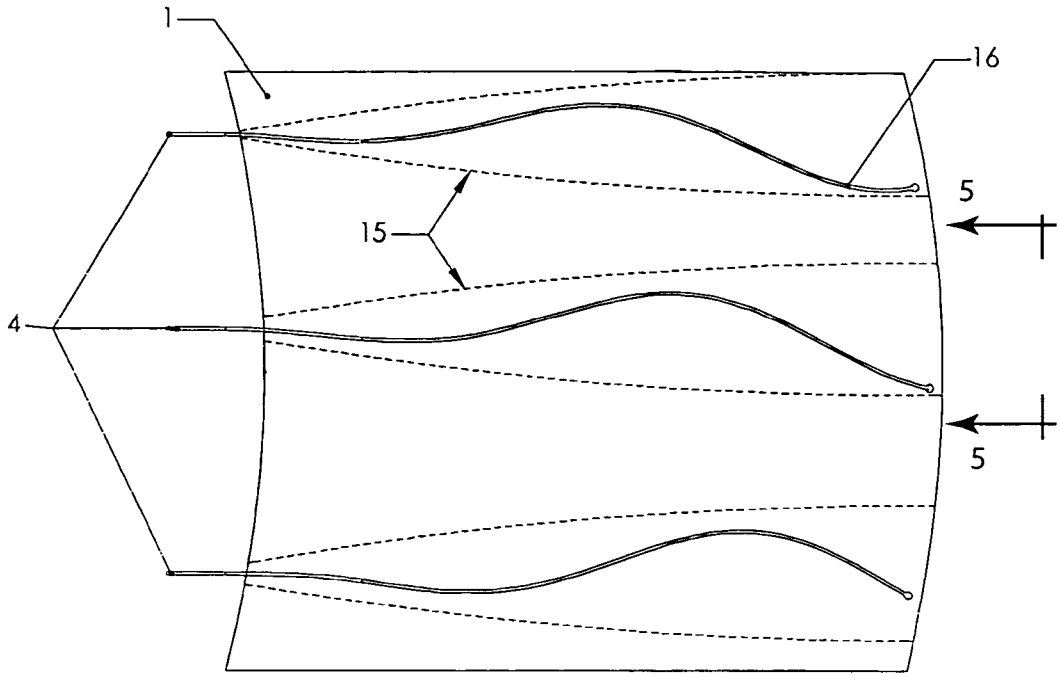
FIG. 4 is an illustration of the flag with the elements residing in sewn pockets within the flag body as viewed from the opposite side of the flag from FIG. 1.
Figure 5:
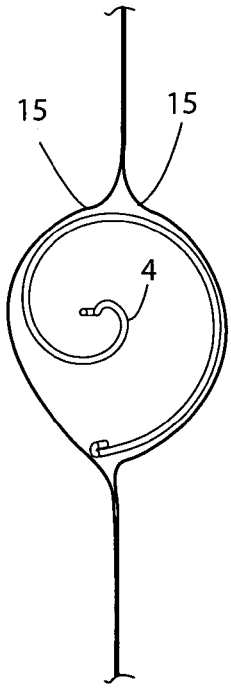
FIG. 5 is an end view of one of the elements illustrating a preferred spiral configuration.

From a review of FIGS. 1, 3, and 4, it will be appreciated that the elements 4 include portions, spaced from their end portions engaged by the bevel gears, which are offset from the axes of rotation of the associated bevel gears. The elements 4, for example, are preferably spiral shape, and elements 4 may be of the same spiral shape or have different spiral shapes. These elements 4 may also be sinuously shaped, or more generally, simply have portions offset from the rotational axes of the end portions engaging the bevel gears. Moreover, the offset portions of the elements 4 may be out of phase with one another to provide more interesting rippling effects. The spiral shape of the elements 4 is best seen in FIG. 5 looking at an element 4 from the end. As illustrated, elements 4 preferably have increasing diameters in a direction away from their end portions at the support, i.e. adjacent the gears, for simulating the rippling effect of the flag being larger in a direction away from the support. A spiral of one and one-half revolutions has been found effective.

Referring to FIG. 3, the rotational angle and the horizontal position of a point in the middle of each of the elements 4 are graphed versus time. The rotation is preferably continuous, but the phase angle of each element may be altered relative to the other elements, for example, by 30 to 90 degrees. This will afford a rippling effect indicated by the ripples in the plot of FIG. 3.

More particularly, and referring to FIG. 4, the support 2 extends vertically and the flag extends laterally from the vertical support. The rippling of the flag is primarily composed of horizontal in and out movements, i.e. lateral movements of the flag material with very little motion in the vertical direction. This is accomplished by mechanically converting the rotating movement of each point on the elements 4 which extend beyond the end portions thereof and which are offset from the axis of rotation into a horizontal movement of the flag.

In FIG. 4, the flag comprises two layers of material sewn together about the outer edges of the flag and by a pattern illustrated by the dashed lines. The sewing along the dashed lines forms a series of pockets 15 which receive the elements 4. From FIG. 4, it will be appreciated that the elements 4, upon rotation about horizontal axes adjacent the left-hand ends thereof, can move within and relative to the pockets. More particularly, each point along an offset portion of the element 4 will move vertically, i.e., up and down in the pocket 15 while lateral in and out movements cause the flag to move laterally in and out. Note also that the preferred spiral shape of the elements with increasing diameters in directions away from the support providing the rippling effect also in that same direction away from the support affording a close approximation or simulation of a flag actually waving in the wind. In FIG. 4, the elements 4 are illustrated out of phase with one another which affords a more convincing rippling illusion.

Figure 2:
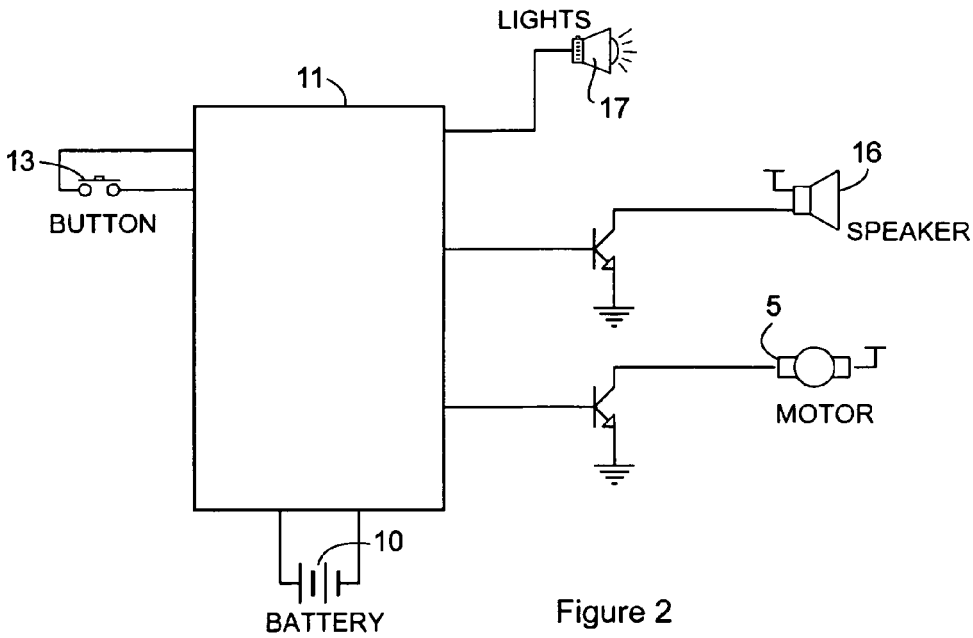
FIG. 2 is an electrical schematic diagram for operating the apparatus FIG. 1.

Referring now to FIG. 2, there is located within the base, a sound chip 11 forming part of an electronics package 8. The sound chip 11, for example, may be a W528S10 voice chip available from Winbond Corporation. The sound chip is activated by a button 13 preferably located in the base. This particular chip will store 12 seconds of music and provide actuation for the motor and a light and can be programmed with selected music, for example, patriotic music to match the flag being displayed. The chip is connected by a drive transistor to a loud speaker 9 and also to another drive transistor to the motor 5 to apply power from the battery 10 to the motor 5 to rotate the shaft 7 when the sound chip plays music. The controller chip will turn off the motor 5 and revert to a low power mode after the music has been played. It will also be appreciated that while the preferred form of the present invention provides a base having a battery as the power source, a standard electrical power source may be used in lieu of a battery. Also, other types of mechanisms may be used to rotate elements 4 than the preferred bevel gears and shaft 7.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. Apparatus for waving a flag comprising:

a flexible flag body;

an elongated support;

a plurality of elongated elements carried by said support and spaced from one another, said elements extending generally along said flag body and projecting the flag body generally laterally of the support;

said elements having end portions carried by said support for rotation about generally parallel axes perpendicular to the elongated support and in the direction of the flag body, said end portions being spaced from one another along said support;

portions along said elements spaced generally laterally from said end portions lying offset from said axes of rotation; and means for rotating the elements about said axes of rotation enabling the flag body to follow the motion of the offset portions thereby causing a rippling effect along the flexible flag body.

2. Apparatus according to claim 1, wherein said rotating means includes a motor, a shaft driven by said motor and gearing coupled between said shaft and said end portions of said elements.

3. Apparatus according to claim 2, including a base for mounting said support in an upright orientation, a battery carried by said base for electrically energizing said motor, said shaft extending within said support with said end portions extending laterally through openings in said support.

4. Apparatus according to claim 1, wherein said elements extend in generally sinuous configurations from said end portions thereof.

5. Apparatus according to claim 4, wherein said sinuous configurations of said elements are out of phase with one another.

6. Apparatus according to claim 1, wherein said flag body includes a plurality of pockets generally in a plane containing said flag body, the offset portions of said elements being received in said pockets and moveable within said pockets to displace the flag portions of the flag body out of the plane thereof.

7. Apparatus according to claim 6, wherein margins of said pockets diverge from one another in a direction away from said end portions.

8. Apparatus for waving a flag comprising:

a flexible flag body;

an elongated support;

a plurality of elongated elements carried by said support and spaced from one another, said elements extending generally along said flag body and projecting the flag body generally laterally of the support;

said elements having end portions carried by said support for rotation about generally parallel axes, said end portions being spaced from one another along said support;

portions along said elements spaced generally laterally from said end portions lying offset from said axes of rotation; and means for rotating the elements about said axes of rotation enabling the flag body to follow the motion of the offset portions thereby causing a rippling effect along the flexible flag body;

each of said elements having a generally spiral shape and having larger diameter portions spaced therealong at increasing distances from said end portions of the elements.

9. Apparatus for waving a flag comprising:

a flexible flag body;

an elongated support;

a plurality of elongated elements carried by said support and spaced from one another, said elements extending generally along said flag body and projecting the flag body generally laterally of the support;

said elements having end portions carried by said support for rotation about generally parallel axes, said end portions being spaced from one another along said support;

portions along said elements spaced generally laterally from said end portions lying offset from said axes of rotation;

means for rotating the elements about said axes of rotation enabling the flag body to follow the motion of the offset portions thereby causing a rippling effect along the flexible flag body; and a base for mounting said support in an upright orientation, a motor in said base, a shaft driven by said motor and extending within said support, gearing coupled between said shaft and said end portions of said elements, said base including a sound controller connecting at least one speaker coupled to said sound controller for creating sound as the flag is waved.

10. Apparatus according to claim 9, including a battery within said base and at least one light coupled to said battery for lighting the flag.

11. Apparatus for waving a flag comprising:

a flexible flag body;

an elongated support;

a plurality of elongated elements carried by said support and spaced from one another along said flag body;

said elements having movable non-linear portions spaced from one another and engageable with and movable relative to said flag body enabling the flag body to follow the movement of the non-linear portions thereby causing a rippling effect along the flexible flag body.

12. Apparatus according to claim 11 wherein said elements are shaped to provide the rippling effect in a direction away from the support.

13. Apparatus according to claim 11, including a motor, a shaft driven by said motor and couplings between said shaft and said elements enabling movement of said non-linear portions in response to actuation of said motor.

14. Apparatus according to claim 13, including a base for mounting said support in an upright orientation, a battery carried by said base for electrically energizing said motor, said shaft extending within said support.

15. Apparatus according to claim 11, wherein said elements extend in generally sinuous configurations from said support.

16. Apparatus according to claim 15, wherein said sinuous configurations of said elements are out of phase with one another.

17. Apparatus according to claim 11, wherein said flag body includes a plurality of pockets generally in a plane containing said flag body, the non-linear portions of said elements being received in said pockets and moveable within said pockets to displace the flag portions of the flag body out of a plane thereof.

18. Apparatus according to claim 17, wherein margins of said pockets diverge from one another in a direction away from said support.

19. Apparatus for waving a flag comprising:

a flexible flag body;

an elongated support;

a plurality of elongated elements carried by said support and spaced from one another along said flag body;

said elements having movable non-linear portions spaced from one another and engageable with said flag body enabling the flag body to follow the movement of the non-linear portions thereby causing a rippling effect along the flexible flag body and wherein said elements project the flag body generally laterally of the support, said non-linear portions of said elements lying at different vertical and lateral locations along said flag body in response to movement of said elements.

20. Apparatus for waving a flag comprising:

a flexible flag body;

an elongated support;

a plurality of elongated elements carried by said support and spaced from one another along said flag body;

said elements having movable non-linear portions spaced from one another and engageable with said flag body enabling the flag body to follow the movement of the non-linear portions thereby causing a rippling effect along the flexible flag body; and a base for mounting said support in an upright orientation, a motor in said base, a shaft driven by said motor and extending within said support, couplings between said shaft and said elements, said base including a sound controller connecting at least one speaker coupled to said sound controller for creating sound as the flag is waved.

21. Apparatus according to claim 20, including a battery within said base and at least one light coupled to said battery for lighting the flag.

22. Apparatus for waving a flag comprising:

a flexible flag body;

an elongated support;

a plurality of elongated elements carried by said support and spaced from one another along said flag body;

said elements having movable non-linear portions spaced from one another and engageable with said flag body enabling the flag body to follow the movement of the non-linear portions thereby causing a rippling effect along the flexible flag body;

each of said elements having a generally spiral shape with larger diameter portions spaced therealong at increasing distances from said support.

* * * * *